US007549493B1

(12) United States Patent
Jones

(10) Patent No.: US 7,549,493 B1
(45) Date of Patent: Jun. 23, 2009

(54) WET BELT SUPERCHARGER DRIVE FOR A MOTORCYCLE

(76) Inventor: Daniel W. Jones, 14801 W. 114th Ter., Lenexa, KS (US) 66215

( * ) Notice: Subject to any disclaimer, the term of this patent is extended or adjusted under 35 U.S.C. 154(b) by 473 days.

(21) Appl. No.: 11/307,945

(22) Filed: Feb. 28, 2006

(51) Int. Cl.
*F02B 33/00* (2006.01)

(52) U.S. Cl. ..... 180/68.3; 180/219; 123/559.1

(58) Field of Classification Search ..... 180/219, 180/68.3; 123/559.1
See application file for complete search history.

(56) References Cited

U.S. PATENT DOCUMENTS

| | | | |
|---|---|---|---|
| 1,265,418 | A | 5/1918 | Baldwin |
| 2,201,693 | A | 12/1938 | Heess et al. |
| 2,514,897 | A | 7/1950 | Paulsen |
| 2,525,695 | A | 10/1950 | Lombard |
| 3,195,324 | A | 7/1965 | Sellwood et al. |
| 3,427,827 | A | 2/1969 | Airheart |
| 3,905,340 | A | 9/1975 | Boyesen |
| 4,000,723 | A | 1/1977 | Boyesen |
| 4,084,378 | A | 4/1978 | Blake |
| RE30,425 | E | 11/1980 | Boyesen |
| 4,417,559 | A | 11/1983 | Matsuda et al. |
| 4,427,087 | A | 1/1984 | Inoue et al. |
| 4,428,227 | A | 1/1984 | Yamagata et al. |
| 4,432,205 | A | 2/1984 | Inoue et al. |
| 4,436,172 | A | 3/1984 | Inoue et al. |
| 4,438,828 | A | 3/1984 | Nakagawa |
| 4,440,255 | A | 4/1984 | Shinozaki |
| 4,444,013 | A | 4/1984 | Inoue et al. |
| 4,452,330 | A | 6/1984 | Matsuyama |
| 4,454,719 | A | 6/1984 | Shinozaki et al. |
| 4,469,189 | A | 9/1984 | Minami et al. |
| 4,475,341 | A | 10/1984 | Inoue et al. |
| 4,475,617 | A | 10/1984 | Minami et al. |
| 4,480,712 | A | 11/1984 | Inoue et al. |
| 4,482,024 | A | 11/1984 | Matsuda et al. |
| 4,495,773 | A | 1/1985 | Inoue et al. |
| 4,513,725 | A | 4/1985 | Minami et al. |
| 4,550,794 | A | 11/1985 | Inoue et al. |
| 4,735,178 | A | 4/1988 | Inoue et al. |
| 4,760,703 | A | 8/1988 | Minami et al. |

(Continued)

FOREIGN PATENT DOCUMENTS

| | | |
|---|---|---|
| EP | 0707141 | 10/1995 |

(Continued)

OTHER PUBLICATIONS

Blower technology commercially available from Woody's Blower Technologies as shown in printout from the website www.wbtinc.com (printed Oct. 1, 2003).

(Continued)

*Primary Examiner*—Kevin Hurley

(57) ABSTRACT

A supercharged motorcycle is disclosed and broadly includes a motorcycle and an air induction system. The supercharged motorcycle includes a case that partly houses a drive train of the motorcycle within a first case compartment and a wet belt drive of the air induction system within a second case compartment. The wet belt drive incorporates a toothed belt that enables a slip mechanism of the wet belt drive for protecting the motorcycle engine. The two adjacent compartments of the case fluidly communicate and are configured such that the wet belt drive can be compactly assembled onto the motorcycle.

20 Claims, 8 Drawing Sheets

U.S. PATENT DOCUMENTS

| | | | |
|---|---|---|---|
| 4,802,684 | A | 2/1989 | Bennett et al. |
| 4,844,044 | A | 7/1989 | McGovern |
| 4,864,825 | A | 9/1989 | Kakuta |
| 4,891,946 | A | 1/1990 | Inoue |
| 4,900,343 | A | 2/1990 | Minami et al. |
| 4,907,552 | A | 3/1990 | Martin |
| 4,953,352 | A | 9/1990 | Campbell |
| 5,263,463 | A | 11/1993 | Perry |
| 5,285,752 | A | 2/1994 | Reed et al. |
| 5,307,771 | A | 5/1994 | Stahel, II et al. |
| 5,401,055 | A | 3/1995 | Pham |
| 5,460,145 | A | 10/1995 | Perry, Jr. |
| D367,444 | S | 2/1996 | Davidson et al. |
| 5,586,540 | A | 12/1996 | Marzec et al. |
| 5,636,618 | A | 6/1997 | Kirstein |
| 5,682,870 | A | 11/1997 | Motoyama |
| 5,778,857 | A | 7/1998 | Nakamura et al. |
| 5,826,463 | A | 10/1998 | Monson |
| 5,826,900 | A | 10/1998 | Steele |
| 5,845,618 | A | 12/1998 | Taue et al. |
| 5,946,908 | A | 9/1999 | Motoyama et al. |
| 6,001,436 | A | 12/1999 | Strasser et al. |
| 6,012,436 | A | 1/2000 | Boutcher |
| 6,016,655 | A | 1/2000 | Boswell |
| 6,055,959 | A | 5/2000 | Taue |
| 6,105,558 | A | 8/2000 | Bushling |
| 6,173,983 | B1 | 1/2001 | Moore |
| 6,238,617 | B1 | 5/2001 | Strasser et al. |
| 6,257,190 | B1 | 7/2001 | Linebarger |
| 6,276,482 | B1 | 8/2001 | Moriya et al. |
| 6,295,974 | B1 | 10/2001 | McCants |
| 6,394,058 | B2 | 5/2002 | Fegg |
| 6,439,208 | B1 | 8/2002 | Jones |
| 6,474,318 | B1 | 11/2002 | Jones et al. |
| 6,478,016 | B1 | 11/2002 | Roderique |
| 6,478,469 | B1 | 11/2002 | Jones |
| 6,516,788 | B1 | 2/2003 | Roderique |
| 6,516,789 | B1 | 2/2003 | Jones |
| 6,571,780 | B1 | 6/2003 | Jones et al. |
| 6,612,747 | B1 | 9/2003 | Jones |
| 6,651,633 | B1 | 11/2003 | Jones |
| 6,691,685 | B2 | 2/2004 | Jones et al. |
| 7,051,824 | B1 | 5/2006 | Jones et al. |
| 2002/0011222 | A1 | 1/2002 | Bilek et al. |
| 2003/0150433 | A1 | 8/2003 | Jones et al. |
| 2006/0093477 | A1 | 5/2006 | Jones |

FOREIGN PATENT DOCUMENTS

| | | |
|---|---|---|
| JP | 57046024 | 9/1980 |
| JP | 57046025 | 9/1980 |
| JP | 57046026 | 9/1980 |
| JP | 57046027 | 9/1980 |
| JP | 57046060 | 9/1980 |
| JP | 57051528 | 9/1980 |
| JP | 57052620 | 9/1980 |
| JP | 57052626 | 9/1980 |
| JP | 57055223 | 9/1980 |
| JP | 57055224 | 9/1980 |
| JP | 57062929 | 9/1980 |
| JP | 57062930 | 9/1980 |
| JP | 57065816 | 10/1980 |
| JP | 57079215 | 11/1980 |
| JP | 57099233 | 12/1980 |
| JP | 57102510 | 12/1980 |
| JP | 57102519 | 12/1980 |
| JP | 57055222 | 1/1981 |
| JP | 57121926 | 1/1981 |
| JP | 57121928 | 1/1981 |
| JP | 57122120 | 1/1981 |
| JP | 57124027 | 1/1981 |
| JP | 57126721 | 1/1981 |
| JP | 57126722 | 1/1981 |
| JP | 57126723 | 1/1981 |
| JP | 58044221 | 9/1981 |
| JP | 58185927 | 4/1982 |
| JP | 58185929 | 4/1982 |
| JP | 58185930 | 4/1982 |
| JP | 58185932 | 4/1982 |
| JP | 61004828 | 6/1984 |
| JP | 61093231 | 10/1984 |
| JP | 61096136 | 10/1984 |
| JP | 1301918 | 5/1988 |
| JP | 1301919 | 5/1988 |
| JP | 1313624 | 6/1988 |
| JP | 2006289 | 6/1988 |
| JP | 2016330 | 6/1988 |
| JP | 2024283 | 7/1988 |
| JP | 2024284 | 7/1988 |
| JP | 8114124 | 10/1994 |
| JP | 8114125 | 10/1994 |
| JP | 8114123 | 11/1994 |
| JP | 8151926 | 11/1994 |
| JP | 9287472 | 4/1996 |
| JP | 2001233276 | 8/2001 |
| JP | 57121929 | 3/2007 |

OTHER PUBLICATIONS

Gates Corporation Brochure for Poly Chain GT2 Belt Drive Systems (Published Apr. 2005).

Printout from Gates Corporation website (www.gates.com) (printed May 27, 2005).

Tony Foale, "Motorcycle Handling and Chassis Design the Art and Science" (2002).

WET BELT SUPERCHARGER DRIVE FOR A MOTORCYCLE

BACKGROUND OF THE INVENTION

1. Field of the Invention

The present invention relates generally to the field of supercharged motorcycles. More specifically, the present invention concerns a supercharger drive for a motorcycle that fluidly communicates with the motorcycle drive train.

2. Discussion of Prior Art

It is known in the art to supercharge an internal combustion engine to provide increased airflow to the engine and thereby enhance the power output of the engine. There are several types of superchargers known in the art, including, for example, Roots-type superchargers and centrifugal superchargers, both of which are driven off of the crankshaft of the engine. One exemplary centrifugal supercharger well advanced in the art and particularly resistant to failure is disclosed in U.S. application patent Ser. No. 10/641,619 entitled CENTRIFUGAL COMPRESSOR WITH IMPROVED LUBRICATION SYSTEM FOR GEAR-TYPE TRANSMISSION, filed Aug. 14, 2003 (the "Jones '619 application"), hereby incorporated by reference herein.

It is also known in the art to supercharge a motorcycle engine, including the distinctive V-twin engine design found on Harley-Davidson® motorcycles. However, motorcycle engines and particularly Harley-Davidson® V-twin motorcycle engines present a number of design considerations. For example, prior art superchargers, particularly superchargers that do not utilize multiple bearing arrangements or a self-contained dedicated lubrication system, can be subject to premature failure, or failure prior to the life expectancy of the motorcycle's engine, particularly where the drive assembly is not maintained within very tight tolerances. Failure of these prior art superchargers can be problematic as it may in turn cause catastrophic engine failure. Prior art superchargers are often interconnected to the motorcycle drive train with geared drives. One of these drives is disclosed in U.S. application patent Ser. No. 10/605,880 entitled SUPERCHARGED MOTORCYCLE, filed Nov. 3, 2003 (the Jones '880 application), hereby incorporated by reference herein. The potential for such engine failure is exacerbated where the supercharger is directly integrated with the engine, such as sharing a common lubrication system, as foreign debris occasioned by supercharger failure can leak into the internal components of the engine.

Additionally, these prior art superchargers and their associated drive assemblies often interfere with the rider's normal operating position. In particular, drive assemblies for superchargers are typically driven off of the engine's crankshaft, however, the crankshaft is typically positioned adjacent the footboard and foot controls of the motorcycle and therefore there is very limited space in and around the crankshaft in which to position drive components. Therefore, in order to place the drive components and/or the supercharger itself in the crowded area around the crankshaft, the components can undesirably alter or interfere with the rider's otherwise normal, comfortable operating position and/or the rider's ability to readily manipulate the foot controls. Additionally, these components in prior art installations may be arranged such that they undesirably affect the balance or reduce the effective bank angle of the motorcycle.

Some of these problems, as well as others, associated with supercharging a V-twin motorcycle engine are exemplified in U.S. Pat. No. 6,105,558 entitled SUPERCHARGING APPARATUS, issued Aug. 22, 2000.

Accordingly, there is a need for an improved drive assembly for use with supercharged motorcycles that does not suffer from these problems and limitations.

SUMMARY OF THE INVENTION

The present invention provides an improved supercharged motorcycle that does not suffer from the problems and limitations of the prior art supercharged motorcycles detailed above. In particular, in a first aspect of the present invention, a motorcycle broadly includes a chassis operable to be mounted by a rider, front and rear wheels that support the chassis, an engine, a drive train, an air induction system delivering compressed induction fluid to the engine, and a case fixed to the chassis. The rear wheel is longitudinally spaced from the front wheel. The engine includes a rotatable crankshaft generally positioned between the wheels. The drive train drivingly interconnects the crankshaft and the rear wheel. The air induction system includes a supercharger and a drive assembly including an endless element. The drive assembly at least partly drivingly interconnects the supercharger and the crankshaft. The case defines first and second compartments. At least part of the drive train is located within the first compartment. The endless element is at least partly located within the second compartment. The first and second compartments are in fluid communication with each other.

A second aspect of the present invention concerns an aftermarket air induction package for assembly onto a motorcycle. The motorcycle has an engine crankshaft drivingly connected to a rear wheel of the motorcycle by a lubricated drive train. The motorcycle further has a case and a case cover defining a lubricant-containing chamber. At least part of the drive train is located within the chamber. The package broadly includes a supercharger, a drive assembly, and a modified cover. The supercharger is configured to supply compressed fluid to the engine. The drive assembly is configured to at least partly drivingly interconnect the supercharger and the crankshaft. The drive assembly includes an endless element. The modified cover is operable to replace the case cover and be sealingly attached to the case. The modified cover is configured to cooperate with the case to provide an enlarged lubricant-containing chamber. The endless element is configured to be at least partly located within the enlarged chamber with the at least part of the drive train when the modified cover is sealingly attached to the case.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
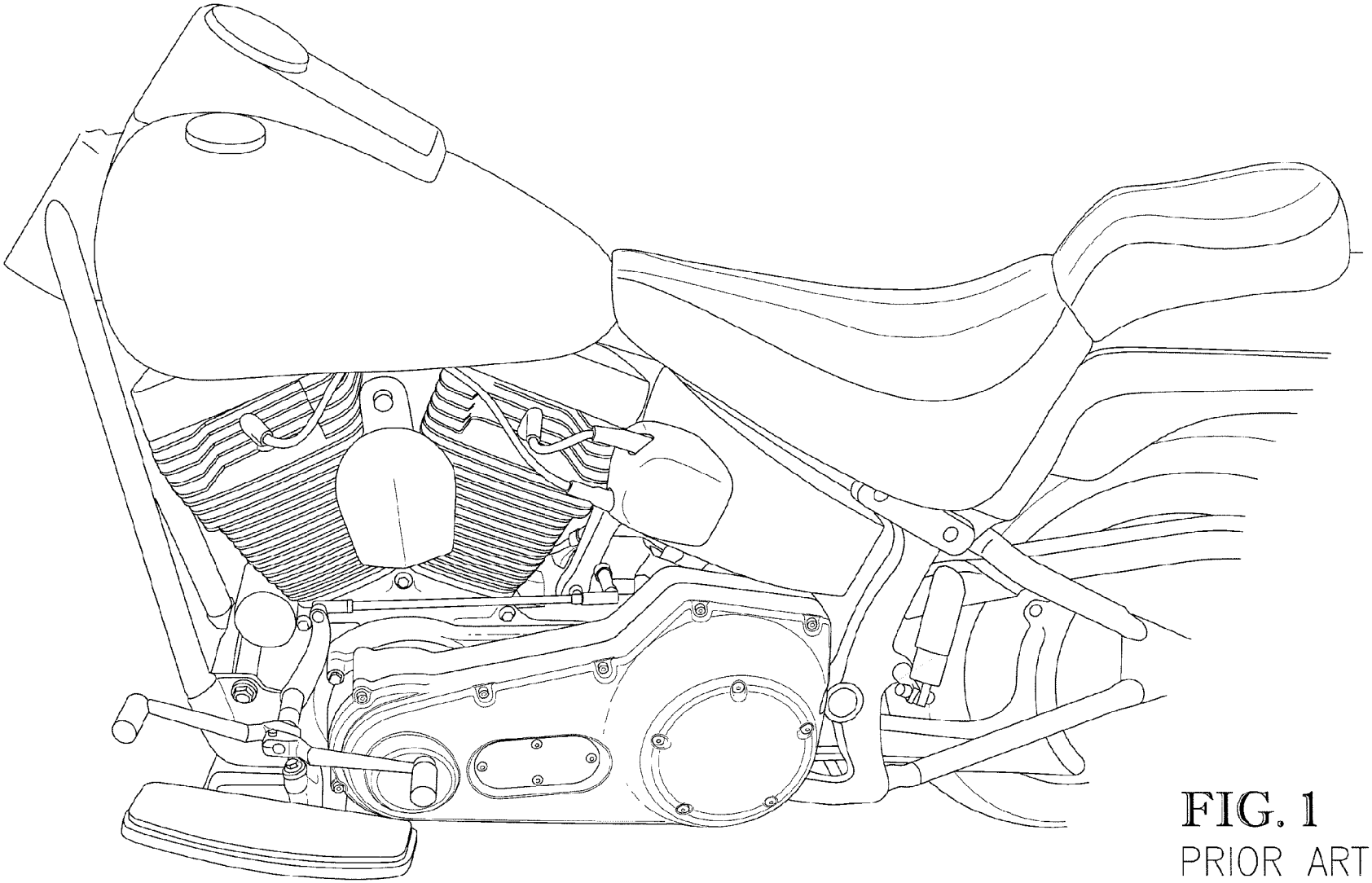
FIG. 1 PRIOR ART
FIG. 1 is a fragmentary left side view of a prior art naturally-aspirated motorcycle.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 2:
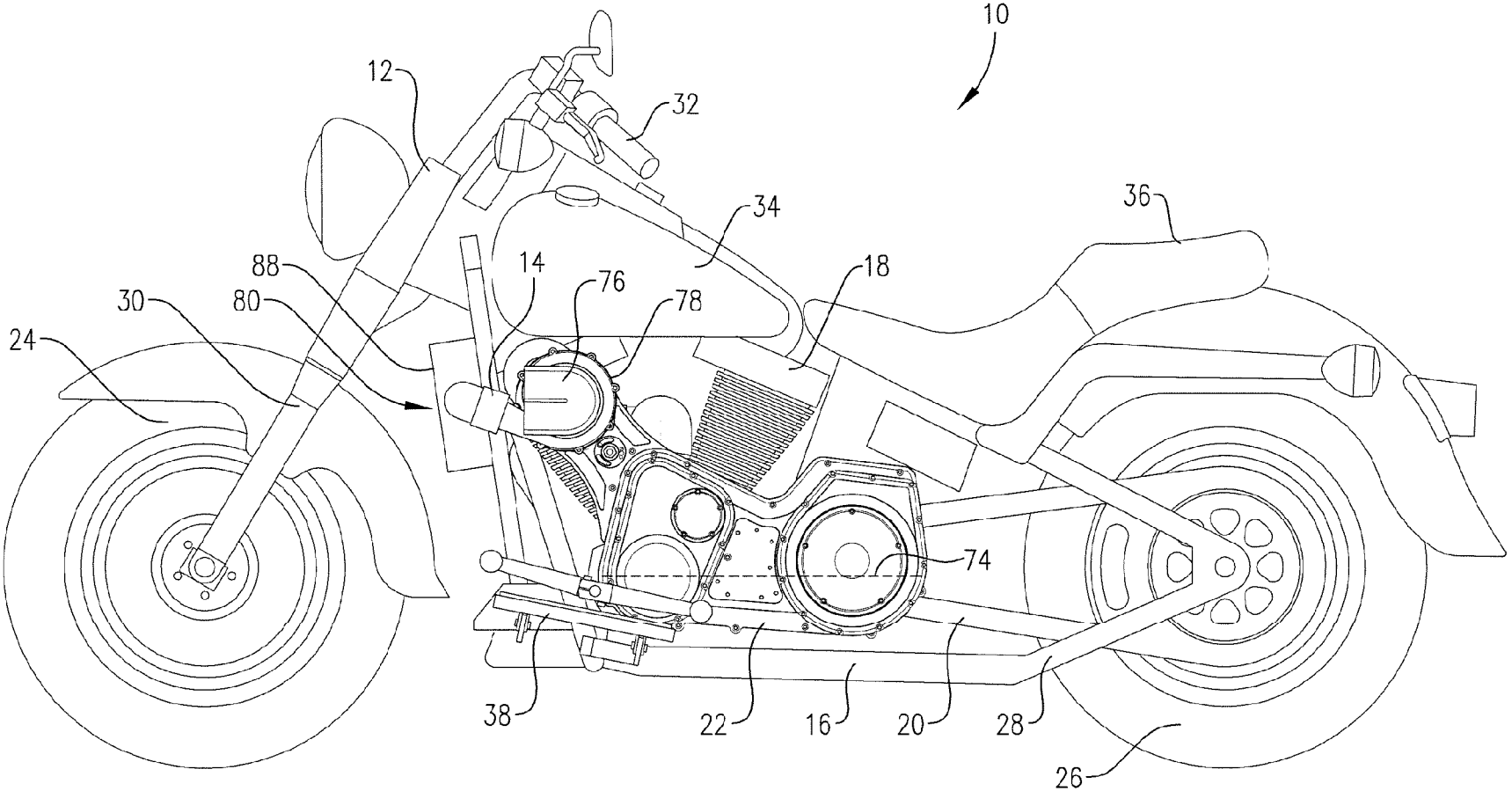
FIG. 2 is a left side elevational view of a supercharged motorcycle including a wet belt supercharger drive constructed in accordance with a preferred embodiment of the present invention.

FIG. 2 illustrates a supercharged motorcycle 10 constructed in accordance with a preferred embodiment of the present invention. As further detailed below, the principles of the present invention are particularly well suited for internal combustion engines, such as the Harley-Davidson® V-twin engine illustrated in FIGS. 1-3, and solve many of the prior art problems that have frustrated, if not virtually made impossible, successful supercharger applications for these engines. However, the principles of the present invention are not limited to any particular type of motorcycle engine and equally apply to virtually any type of engine on virtually any brand of motorcycle. Furthermore, many of the aspects of the present invention also apply to other all-terrain type vehicles, such as three-wheeled and four-wheeled vehicles wherein the rider straddles the chassis of the vehicle in a mounted operating position. The illustrated supercharged motorcycle 10 broadly includes a motorcycle 12 and an air induction system 14 configured to deliver compressed induction fluid to the motorcycle's engine (see FIG. 2).

As shown in FIG. 1, the illustrated prior art motorcycle is a Harley-Davidson® 2001 Softail Fatboy with a rigid mount 1450 cc V-twin Twin Cam 88B balanced engine with electronic fuel injection. The prior art motorcycle includes an engine drivingly connected to a drive train. A chain case projecting out from the left side of the motorcycle includes inner and outer chain case covers and houses a portion of the drive train. A foot pad and adjacent shift lever are closely spaced from the chain case.

The motorcycle 12 depicted in FIG. 2 is also a Harley-Davidson® 2001 Softail Fatboy, which has been retrofitted with aftermarket components to provide the supercharged motorcycle 10. However, it is equally within the ambit of the present invention to provide the components as original equipment on the supercharged motorcycle 10. The motorcycle 12 broadly includes a chassis 16, an engine 18 supported on the chassis 16 for powering the motorcycle 12, a drive train 20 for transmitting power from the engine 18, a case 22 for housing a portion of the drive train 20, and front and rear wheels 24,26.

Figure 3:
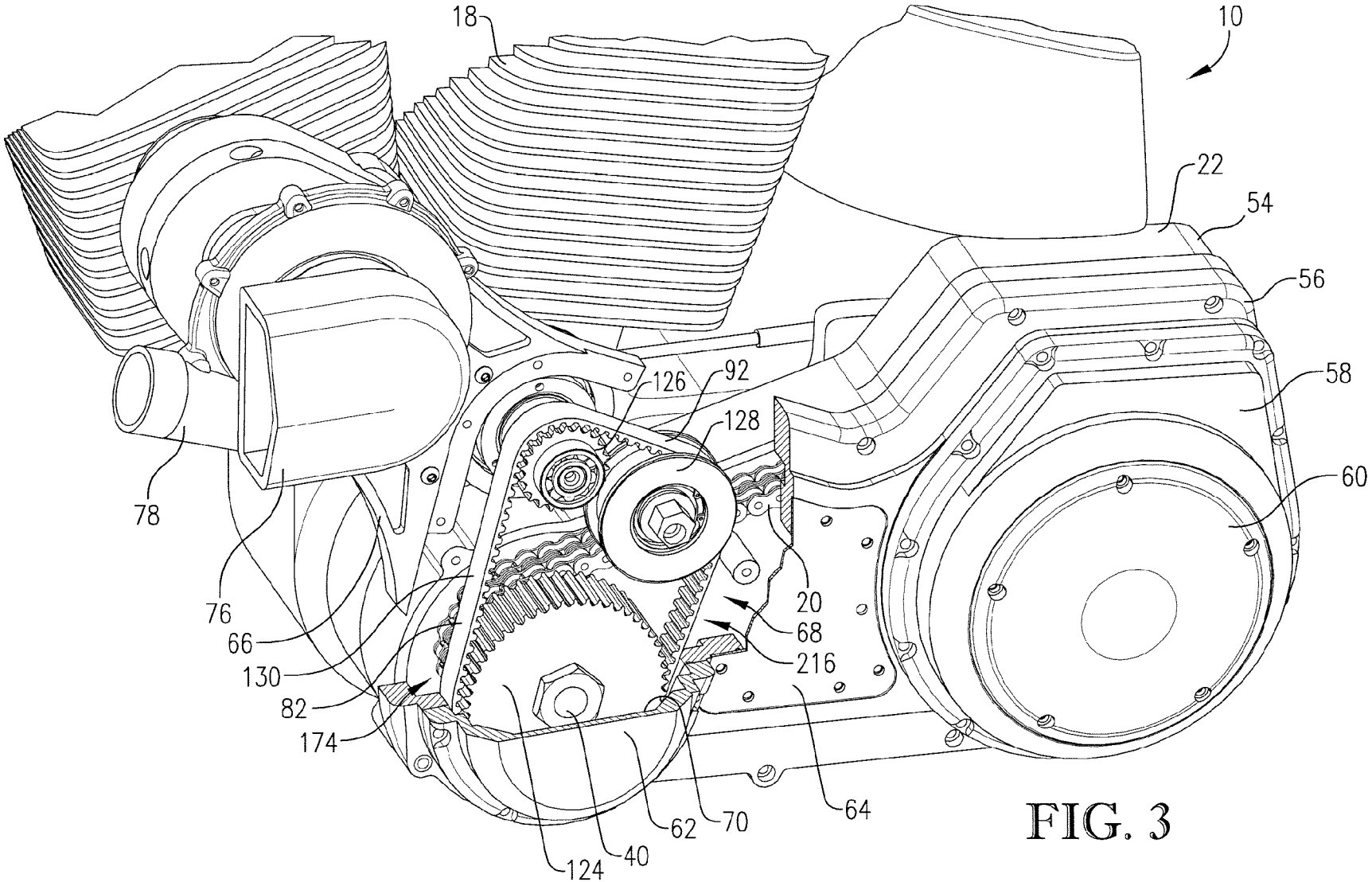
FIG. 3 is an enlarged fragmentary left side partially sectional perspective view of the supercharged motorcycle including the wet belt supercharger drive illustrated in FIG. 2.

Turning to FIGS. 2 and 3, the chassis 16 includes a frame 28 which pivotally supports a fork 30. In the usual manner, the front and rear wheels 24,26 are rotatably attached to the chassis 16 and are aligned along a longitudinal axis of the motorcycle 12. Also supported on the frame 28 is a handlebar 32 for controlling the fork 30. The frame 28 also supports a gas tank 34, a seat 36, and foot boards 38.

The engine 18 is an internal combustion engine and includes a crankshaft 40. The engine 18 is attached to and resides within the frame 28 and between the wheels 24,26. The engine 18 is also arranged so that the crankshaft axis runs horizontally and perpendicular to the longitudinal axis. As discussed above, the engine 18 illustrated is a Harley-Davidson® V-twin engine, but it is within the ambit of the present invention to use other similar reciprocating engines. Additionally, the engine 18 includes an engine intake (not shown) that receives induction fluid as will be discussed in greater detail.

Figure 4:
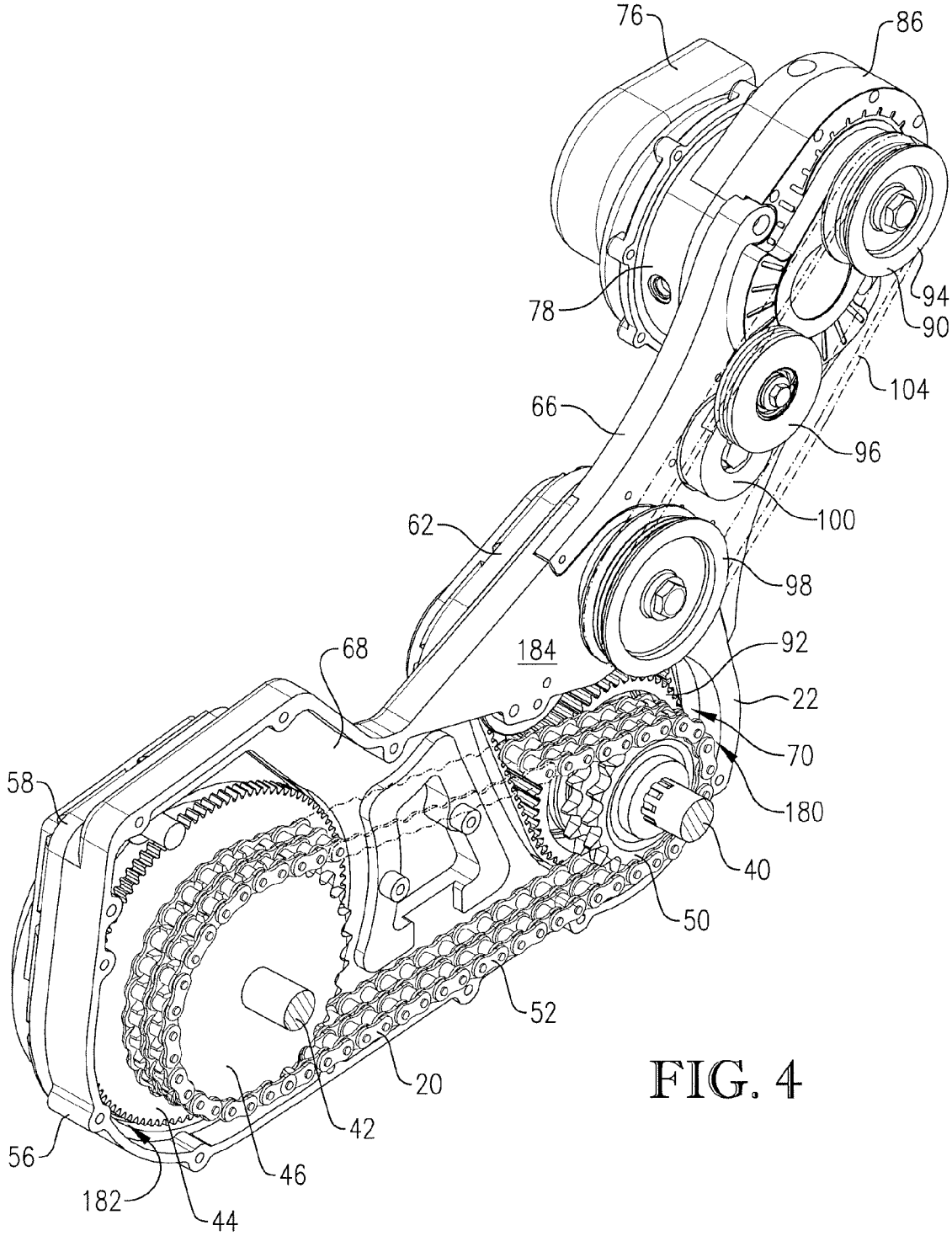
FIG. 4 is an enlarged fragmentary right side perspective view of the supercharged motorcycle including the wet belt supercharger drive illustrated in FIGS. 2 and 3.

Turning to FIGS. 3 and 4, the drive train 20 includes a driven shaft 42, a flywheel 44 and driven sprockets 46. The flywheel 44 and driven sprockets 46 are both releasably coupled to the power take-off shaft 42 by clutch 48 (see FIG. 5). The drive train 20 also includes drive sprockets 50 and endless chains 52 that drivingly interconnect the sprockets 46,50. The drive train 20 further includes a geared transmission (not shown) and a drive chain or belt (not shown) that drives the rear wheel 26. As will be discussed in more detail, portions of the drive train 20 are enclosed in case 22.

The drive train 20 provides selective transmission of power from the engine 18 to the rear wheel 26. The driven shaft 42 is parallel to and spaced rearwardly of the crankshaft 40 and the drive sprockets 50 are attached to the crankshaft 40 so that endless chains 52 run along the longitudinal axis of the motorcycle 12. When the clutch 48 is disengaged, the crankshaft 40 drives the endless chains 52, the driven sprockets 46, and the flywheel 44. When the clutch 48 is engaged, the engine 18 is drivingly interconnected with the rear wheel 26 by the drive train 20. Power is transmitted from the flywheel 44 through the engaged clutch 48 to the driven shaft 42, then through the transmission and drive belt to the rear wheel 26.

Turning to FIGS. 3-6, the case 22 broadly includes inner primary cover 54, outer primary cover 56, inner and outer clutch covers 58,60, belt drive cover 62, inspection covers 64, bracket 66, and fasteners (not shown) to fix the case 22 to the chassis 16. As will be discussed in more detail, the covers 54,56,58,60,62,64 cooperatively form a chain case compartment 68 and a belt drive compartment 70 that are in fluid communication with each other. Most preferably, the case 22 is sealed so that compartments 68,70 may be filled with lubrication fluid up to the fill line 74 illustrated in FIG. 2 and designated by the dotted line. The lubrication fluid is a transmission oil or other similar petroleum or synthetic lubricant. It is also consistent with the principles of the present invention to have an unsealed case that forms, either fully or partially, the compartments 68,70. The illustrated covers 58,60,62,64 and bracket 66 are preferably made from aluminum, but could also be made from steel or other suitable ferrous or non-ferrous materials consistent with the principles of the present invention.

As previously discussed, the drive train 20 is partially housed within the case 22. In particular, the crankshaft 40 and driven shaft 42 extend into and out of the case 22 to transmit power between the engine 18 and the rear wheel 26. The crankshaft 40 and drive sprockets 50 are forwardly spaced within the case 22 and the driven sprockets 46, flywheel 44, and clutch 48 are rearwardly spaced within the case 22.

Turning to FIGS. 2-5, the air induction system 14 delivers compressed induction fluid to an intake manifold (not shown) of the engine 18. The preferred induction system 14 broadly includes an air intake assembly 76 for receiving ambient air, a supercharger 78 fluidly communicating with the air intake assembly 76 for compressing the ambient air and discharging compressed air downstream, an air delivery assembly 80 for receiving the compressed air and delivering it to the intake manifold, and a drive assembly 82 for powering the supercharger 78 from the crankshaft 40.

It will be appreciated that the conventional motorcycle 12 has been modified with the air induction system 14 to arrive at the supercharged motorcycle 10. In this regard, the case 22 has been modified to house some of the components of the air induction system 14 as will be subsequently be described. One or both of the modified case 22 and the air induction system 14 could be originally manufactured and assembled with the motorcycle 12, or these components could be retrofitted onto the motorcycle 12 (e.g., by the end user).

In the illustrated embodiment of FIG. 4, the supercharger 78 is a centrifugal supercharger including a rotatable impeller housed in a volute case. The impeller is driven by powering an input shaft 84 (see FIG. 5) that is drivingly interconnected with the impeller by a transmission 85 housed in a transmission case 86. The supercharger 78 is attached to the motorcycle 12 along its left-hand side, forwardly and upwardly spaced from the crankshaft 40, by attaching the transmission case 86 to the case 22 with bracket 66. The supercharger 78 is arranged so that the impeller and the input shaft 84 rotate about axes that are parallel to the crankshaft 40. When rotated, the impeller draws ambient air through a compressor inlet and delivers compressed air to a compressor discharge. The illustrated drive assembly 82 (along with the supercharger drive assembly) provides a step-up drive mechanism to rotate the impeller at rotational speeds significantly higher than the crankshaft 40. The supercharger arrangement is preferably similar to that disclosed in U.S. application Ser. No. 10/605,880, SUPERCHARGED MOTORCYCLE, assigned of record to the Assignee of the present application, which is hereby incorporated by reference herein.

Due to the high operational speeds of the impeller and the attendant loads on the internal components of the supercharger 78 coupled with the undesirable impact of catastrophic failure of the supercharger 78, the supercharger 78 preferably includes an impeller shaft supported by a velocity variance-reducing multiple bearing arrangement and a dedicated lubrication system for lubricating the internal components of the supercharger 78 Suitable preferred multiple bearing arrangements are disclosed in applicant's U.S. Pat. No. 6,478,469, issued Nov. 12, 2002, entitled VELOCITY VARIANCE REDUCING MULTIPLE BEARING ARRANGEMENT FOR IMPELLER SHAFT OF CENTRIFUGAL SUPERCHARGER, as well as copending applications for U.S. patent Ser. Nos. 09/683,871 and 10/064,835, filed Feb. 26, 2002 and Aug. 22, 2002, respectively, both bearing the same title as the '469 patent, all of which are hereby incorporated by reference herein. Suitable preferred self-contained dedicated lubrication systems are disclosed in the Jones '619 application previously incorporated by reference herein. It is believed a supercharger having a multiple bearing arrangement and/or a self-contained, dedicated lubrication system reduces the risks of premature failure or in the event of such failure, reduces any attendant undesirable engine damage.

In order to maintain the overall original sound of the motorcycle 12, the supercharger 78 may include noise-reducing components and/or features such as a noise-reducing impeller shaft. A suitable noise dampening shaft construction is disclosed in applicant's U.S. Pat. Nos. 6,478,016 and 6,516,788, issued Nov. 12, 2002 and Feb. 11, 2003, respectively, both entitled GEAR DRIVEN SUPERCHARGER HAVING NOISE REDUCING IMPELLER SHAFT, both of which are hereby incorporated by reference herein. It is believed the supercharger designs disclosed in the above incorporated patents and applications combine to provide a supercharger capable of withstanding the operational loads somewhat unique to motorcycle applications, yet enables the supercharger to operate at relatively low noise levels so as not to undesirably hinder the original sound of the motorcycle. In particular, these supercharger designs provide superior long-lasting, durable superchargers that are unlikely to catastrophically fail and are therefore well suited for motorcycle applications. However, it is within the ambit of the present invention to utilize various additional features and/or components for the centrifugal supercharger 78. For example, the supercharger 78 could include a soft material insert within the case such as the one disclosed in applicant's U.S. Patent Application Publication No. 2004/0109760, published Jun. 10, 2004, entitled A METHOD AND APPARATUS FOR INCREASING THE ADIABATIC EFFICIENCY OF A CENTRIFUGAL SUPERCHARGER, which claims the priority of provisional U.S. Application Ser. No. 60/430,814, filed Dec. 4, 2002 and bearing the same title, both of which are hereby incorporated by reference herein.

Figure 5:
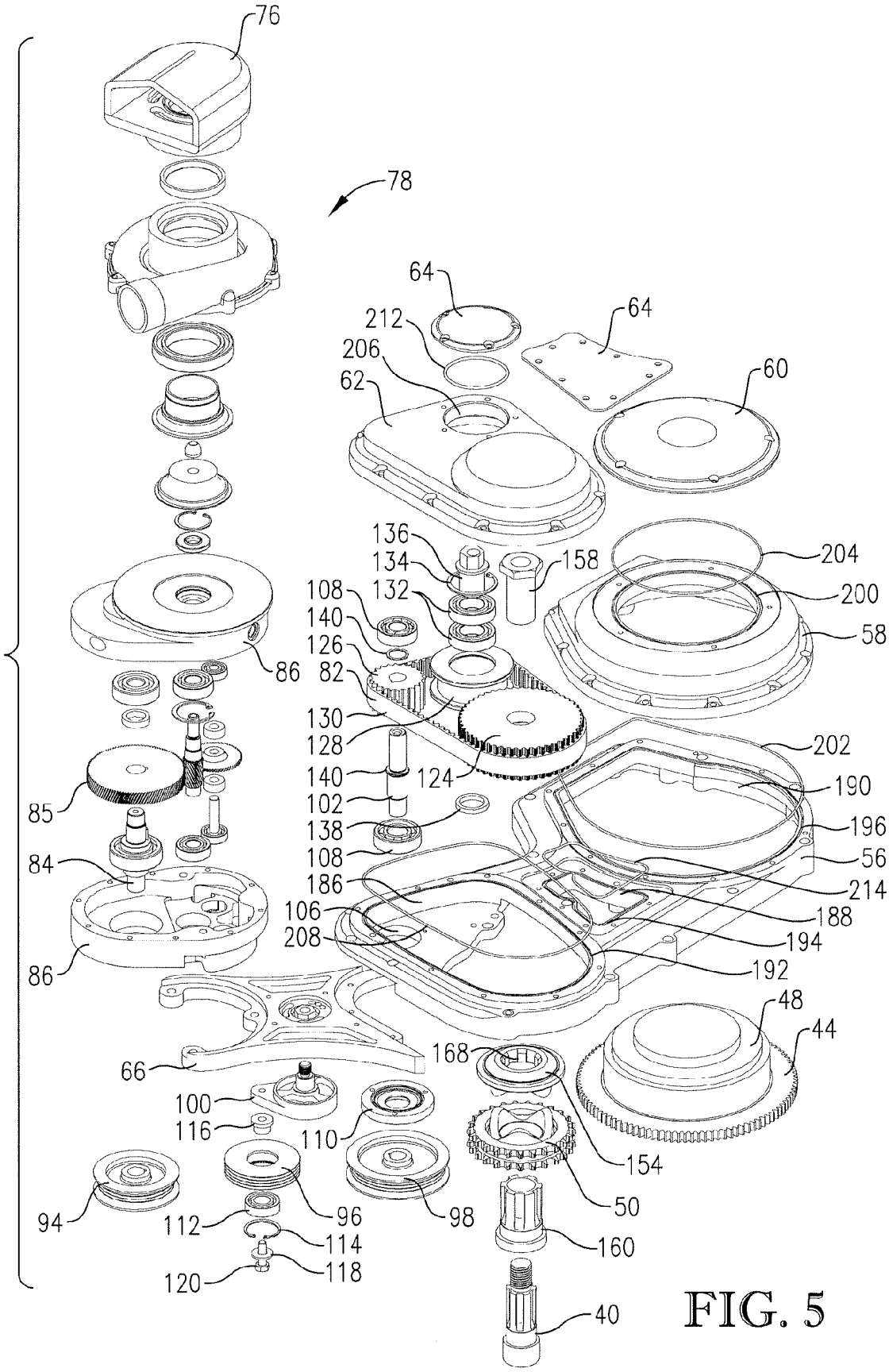
FIG. 5 is a fragmentary exploded view of the supercharged motorcycle including the wet belt supercharger drive illustrated in FIGS. 2-4.
Figure 6:
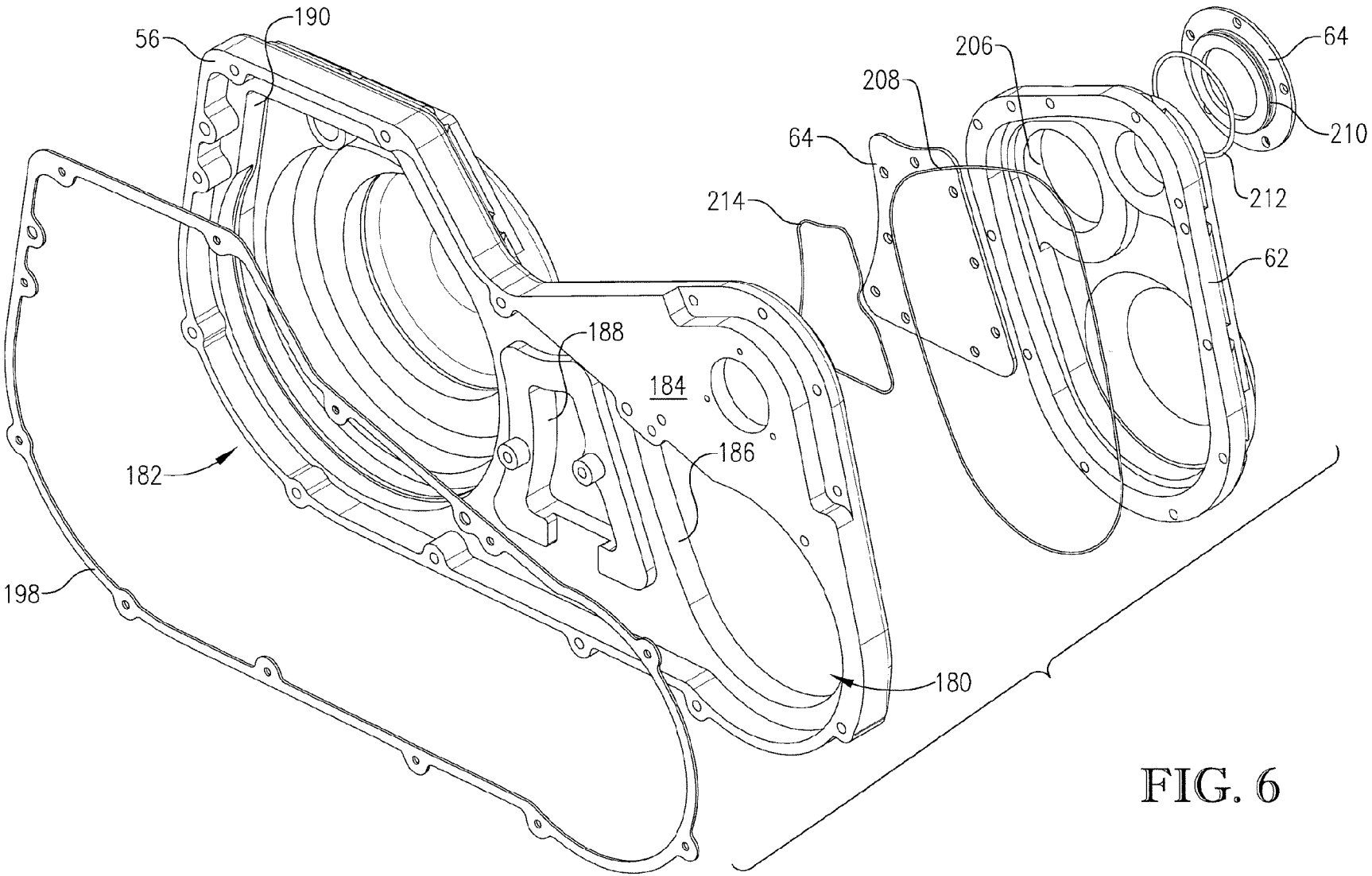
FIG. 6 is a fragmentary exploded view of the supercharged motorcycle including the wet belt supercharger drive illustrated in FIGS. 2-5.

Furthermore, the preferred supercharger 78, illustrated in FIG. 5, includes a rotatable compressor wall insert for reducing the velocity variant between the impeller and the adjacent compressor case similar to the one disclosed in copending application for U.S. patent Ser. No. 10/906,751, filed Mar. 4, 2005, entitled CENTRIFUGAL COMPRESSOR HAVING ROTATABLE COMPRESSOR CASE INSERT and hereby incorporated by reference herein.

Although the above-described centrifugal supercharger 78 is preferred, it is within the ambit of the present invention to utilize virtually any type of compressor for pressurizing induction fluid for the engine 18. For example, the air induction system 14 could utilize a Roots-type blower.

Turning back to FIG. 2, the air delivery assembly 80 is in fluid communication with the supercharger 78 and the intake manifold to deliver compressed air to the engine 18. In more detail, the illustrated air delivery assembly 80 includes an intercooler 88 that cools the compressed induction fluid prior to discharging the air into the manifold. In this regard, the intercooler 88 is an air cooled intercooler and thus is positioned adjacent the front of the motorcycle 12 so as to communicate with the fresh air drawn around the motorcycle 12 as the motorcycle 12 is propelled in the forward direction.

The air delivery assembly 80 could be alternatively configured. For example, the quantity of compressed air delivered to the intake manifold could be controlled by an inlet valve that varies the supply of air to the supercharger in response to downstream air pressure conditions or at the rider's discretion. Such an inlet valve is disclosed in applicant's copending application for U.S. patent Ser. No. 10/249,579, filed Apr. 21, 2003, entitled AIR INDUCTION SYSTEM HAVING INLET VALVE, which is hereby incorporated by reference herein. The air delivery assembly 80 need not include an intercooler and could for example be configured so that the supercharger 78 discharges compressed air directly into the intake manifold without the need for extended tubing.

Turning again to FIGS. 2-5, the drive assembly 82 powers the supercharger 78 and broadly includes an external belt drive 90 substantially located outside of compartments 68,70, and internal belt drive 92 located within compartment 68. Most preferably, the drive assembly 82 is operable to be driven by the crankshaft 40 to step-up the rotational velocity provided to the supercharger 78. However, the principles of the present invention would be equally applicable to the drive assembly 82 if it were driven by the drive train 20. In either case, the drive assembly 82 normally rotates with the drive train 20. However, as will be discussed in greater detail, the drive assembly 82 is also operable to permit the drive train 20 to rotate independently in the event of catastrophic failure of the air induction system 14.

The external belt drive 90 includes a driven sheave 94, idler sheave 96, power take-off sheave 98, pivot arm 100 that supports the idler sheave 96, power take-off shaft 102 that supports the power take-off sheave 98, and endless drive element 104 drivingly interconnecting the sheaves 94,96,98.

In more detail, driven sheave 94 is attached to input shaft 84 and power take-off sheave 98 is rotatably attached outside of the case 22 and adjacent to the outer primary cover 56. In particular, the power take-off sheave 98 is mounted on the power take-off shaft 102. The shaft 102 extends through a port 106 in outer primary cover 56 and into the case 22 and is rotatably supported by ball bearings 108 spaced inside of the case 22. End cap 110 is attached to the outer primary cover 56 and outside of case 22 for retaining the ball bearings 108 and the power take-off shaft 102 and sealing around the power take-off shaft 102.

The pivot arm 100 is pivotally attached to bracket 66 to adjustably locate the idler sheave 96 and thereby provide adjustable tensioning of the endless drive element 104. The idler sheave 96 is supported by a ball bearing 112, which is held within the idler sheave 96 by a snap ring 114. The ball bearing 112 is attached to the pivot arm 100 with a bushing 116 that extends into the inner race of ball bearing 112, a washer 118, and a bolt 120 that extends through the ball bearing 112 and the bushing 116 to be threadably fastened to a threaded hole 122 in the pivot arm 100.

The internal belt drive 92 is located within the case 22 and broadly includes a toothed drive sheave 124, a toothed driven sheave 126, an idler sheave 128, and a toothed endless element 130 that drivingly interconnects the sheaves 124,126, 128. The preferred toothed drive sheave 124, as will be discussed in more detail, includes features that particularly enable its engagement with the toothed endless element 130 while being partially submerged in lubrication fluid. Furthermore, the toothed endless element 130 is designed to transmit power between the sheaves 100,102 while providing a slip mechanism in the event of air induction system failure.

The idler sheave 128 is rotatably supported on the outer primary cover 56 and is adjustable to provide tensioning of the internal belt drive 92. The idler sheave 128 is supported by internal ball bearings 132 which are held in place by snap ring 134. The ball bearings 132 are attached to the outer primary cover 56 by pivotally fastening an eccentric bushing 136 thereto with fasteners (not shown) and a spacer 138 lying between the outer primary cover 56 and the adjacent ball bearing 132. The idler sheave 128 is adjustably positioned by rotating a hex-shaped head of the eccentric bushing 136 and this rotation causes the idler sheave 128 to move either away from or closer to the other sheaves 124,126.

The toothed driven sheave 126 is attached to the power take-off shaft 102 to drive the power take-off sheave 98. The toothed driven sheave 126 is arranged between the ball bearings 108 with spacers 140 on each side of the toothed driven sheave 126 to separate it from each ball bearing 102.

Figure 8:
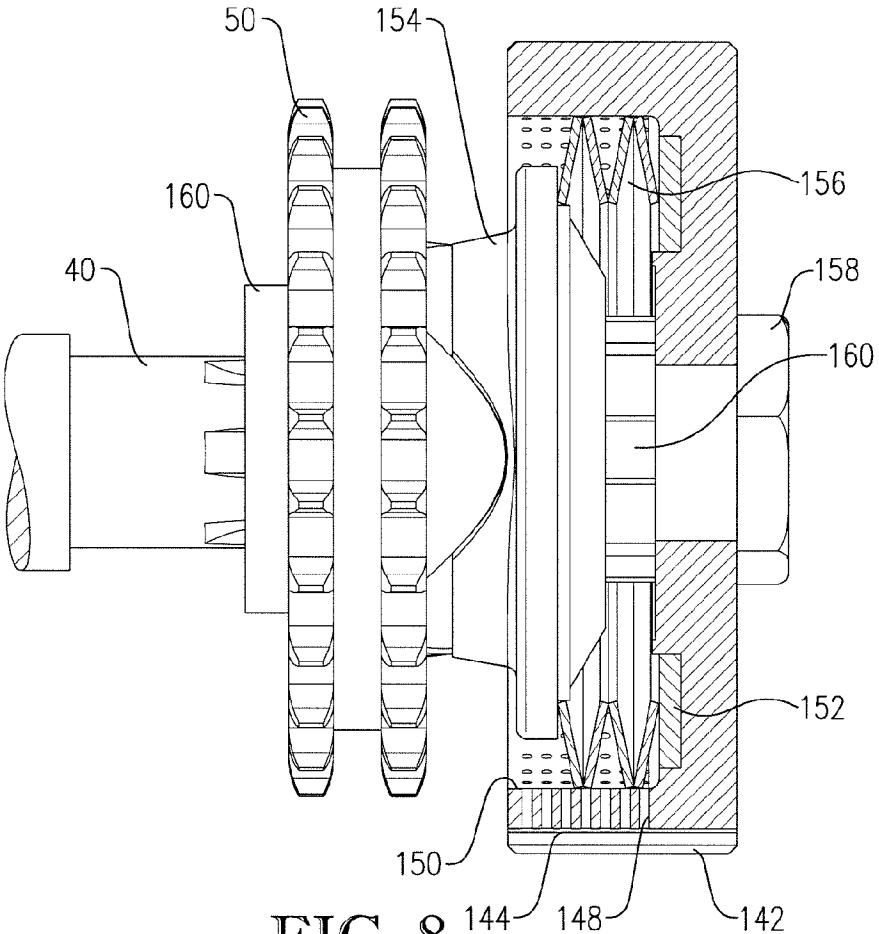
FIG. 8 is an enlarged fragmentary sectional front view of the supercharged motorcycle including the wet belt supercharger drive illustrated in FIG. 2, particularly showing the toothed drive sheave assembled onto the engine crankshaft.
Figure 7:
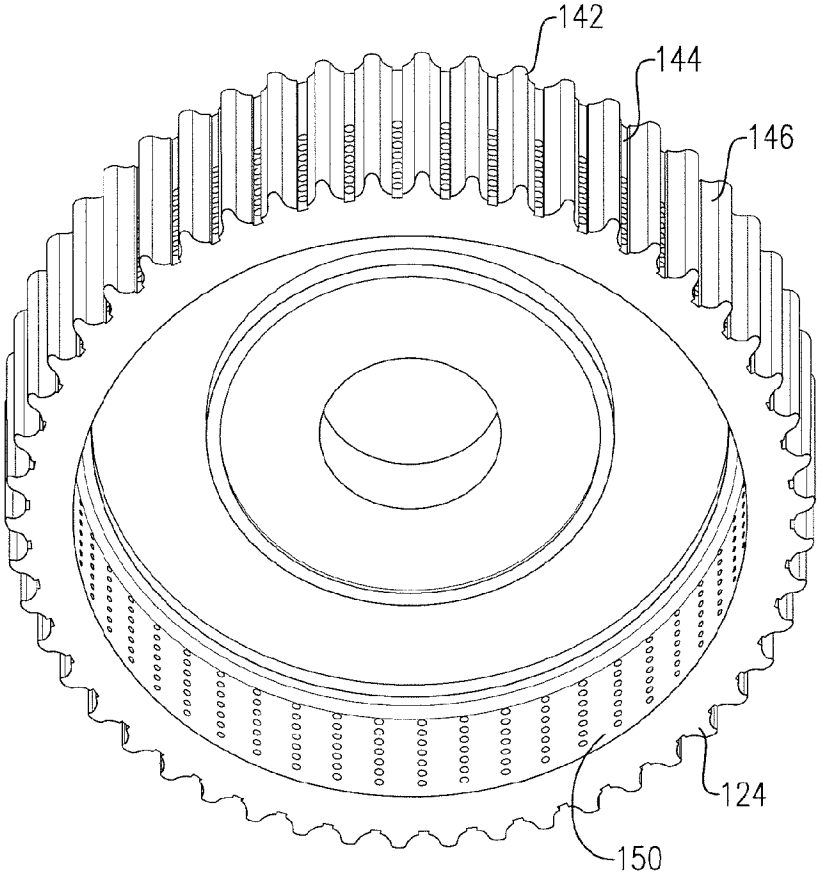
FIG. 7 is an enlarged fragmentary right side perspective view of the wet belt supercharger drive illustrated in FIG. 3 partially showing the toothed drive sheave.

Turning to FIGS. 7 and 8, the toothed drive sheave 124 includes circumferentially spaced teeth 142 with spaces between each pair of adjacent teeth 142 and grooves 144 that project radially inwardly from the spaces. Thus, the teeth 142 and grooves 144 present an outermost perimeter surface 146. Each groove 144 extends parallel to and between a respective pair of teeth 142. Additionally, passages 148 extend radially from the outermost perimeter surface 146 to a circumferential surface 150. The circumferential surface 150 partly defines an internal cavity surrounded by an annular wall of the drive sheave 124 with the cavity being open along both sides of the drive sheave 124. The toothed drive sheave 124 further includes a washer 152. The toothed drive sheave 124 is preferably made from aluminum, but could be made from other suitable non-ferrous or ferrous metals. The washer 152 is preferably made from ferrous metal such as steel.

The teeth 142 and interspaced spaces further present a belt-engaging surface that intermeshes with the toothed endless element 130 (i.e., when a belt tooth is engaged between or intermeshes with a pair of adjacent teeth of the drive sheave). In order to prevent fluid from becoming trapped within the entrained endless element 130 and drive sheave 124, the grooves 144 and passages 148 cooperatively provide a passageway that fluidly communicates with the internal cavity and the outermost perimeter surface 146. The passageway vents the space between the endless element 130 and drive sheave 124 so that fluid may flow into the cavity in response to hydrodynamic pressure developed by the intermeshing endless element 130 and drive sheave 124.

Figure 9:
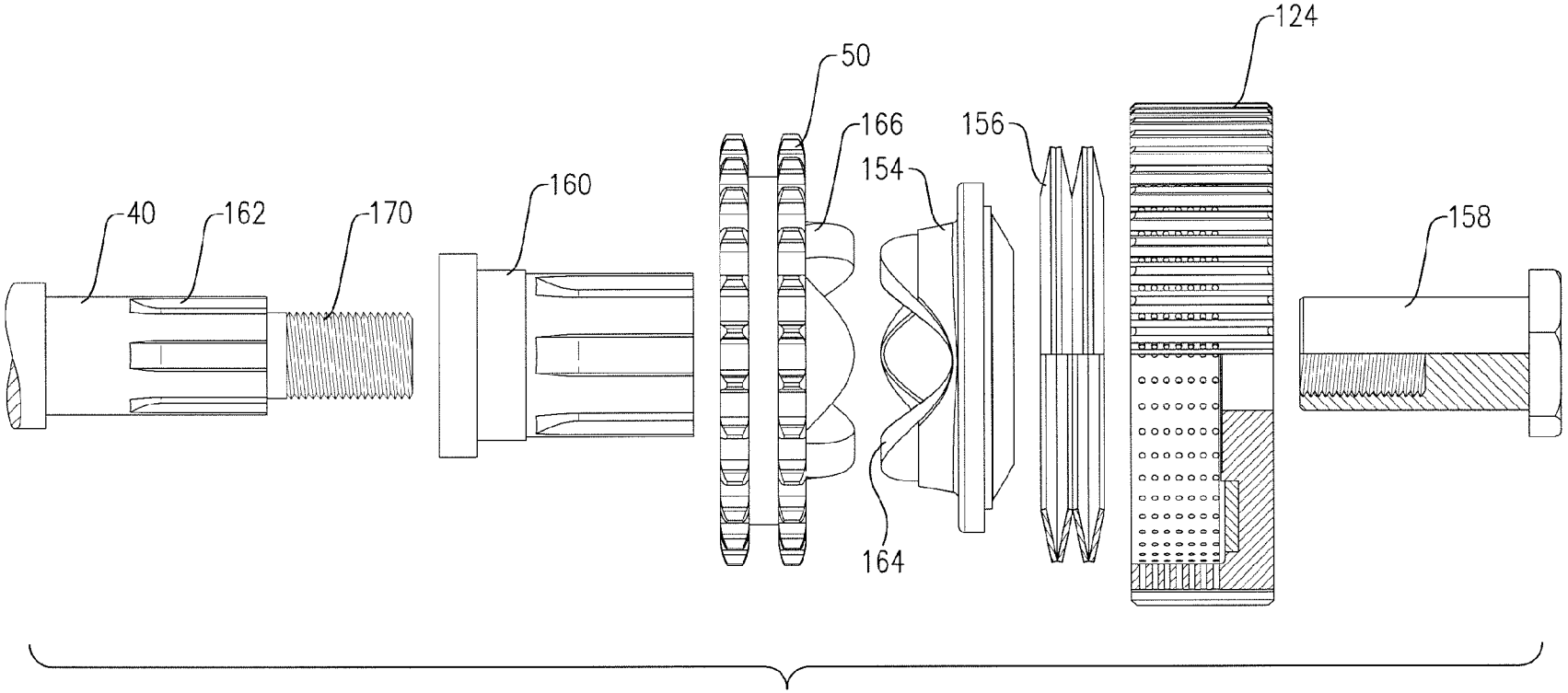
FIG. 9 is an enlarged fragmentary exploded sectional front view of the supercharged motorcycle including the wet belt supercharger drive illustrated in FIG. 2.

Referring to FIGS. 7-9, the toothed drive sheave 124 is attached to the crankshaft 40 with flange coupling 154, Belleville washers 156, nut 158, and splined sleeve 160. The Belleville washers 156 are preferably manufactured from spring steel or stainless steel, but could be manufactured from similar ferrous metals. One such Belleville washer 156 is manufactured by Febrotech GmbH located in Frankfurter, Germany.

The toothed drive sheave 124 is assembled onto the crankshaft 40 by fitting the splined sleeve 160 onto a splined end 162 of the crankshaft 40. The flange coupling 154 includes a cam surface 164 that is arranged to engage a mating surface 166 on the drive sprockets 50. Additionally, the flange coupling 154 includes a splined hole 168 for mating engagement with the external splines of the splined sleeve 160 to be slidable along the crankshaft axis. The toothed drive sheave 124 is then arranged adjacent to the flange coupling 154 with the Belleville washers 156 located therebetween by extending the nut 158 through the toothed drive sheave 124 and threading it onto threads 170 of the splined end 162. The Belleville washers 156 force the flange coupling 154 into engagement with the mating surface 166 and thereby cooperate with the flange coupling 154 to dampen vibration between the drive sprockets 50 and the crankshaft 40.

Preferably, the toothed endless element 130 is a cog belt with internal teeth that transmits up to about 11 horsepower between the toothed sheaves 124,126. More preferably, the toothed endless element 130 is a composite polyurethane belt reinforced with tensile cords made from aramid fiber. One such composite belt is the POLY CHAIN® GT® 2 belt manufactured by Gates Corporation located in Denver, Colo. However, it is consistent with the principles of the present invention to use other kinds of toothed belts or other kinds of endless elements, such as chains. In the preferred embodiment, the use of the toothed endless element 130 in the presence of lubrication fluid enables it to slip relative to the sheaves 124,126 if excessive torque is applied and therefore prevents the inventive drive assembly 82 from transmitting harmful amounts of torque to the crankshaft 40. Moreover, continued slippage of the element 130 relative to the drive sheave 124 in the presence of lubrication fluid causes the element 130 to eventually disintegrate. In this manner, the illustrated toothed endless element 130 protects the engine 18 and other components of the supercharged motorcycle 10.

The nut 158 is tightened so that the toothed drive sheave 124 is compressed between the nut 158 and the splined sleeve 160. In this manner, a limited amount of torque is transmitted between the crankshaft 40 and the toothed drive sheave 124 through friction. Alternatively, it is consistent with the principles of the present invention to use other methods of coupling the toothed drive sheave 124 to the crankshaft 40. One alternative approach would be to fasten a plate to the face of the toothed drive sheave 124 that also has a hex-shaped hole that engages the nut 158.

In this manner, the crankshaft 40 is drivingly interconnected with the supercharger 78. In the event of catastrophic failure of the air induction system 14, the drive assembly 82 enables the engine 18 and the drive train 20 to continue operating without adverse effect. For example, if the supercharger 78 experiences a failure during operation that prevents rotation of the input shaft 84, then a substantial torque is applied to the drive assembly 82 and will act against the crankshaft's normal rotation. The drive sheave 124 will slip relative to the crankshaft 40 where a high torque loading overcomes the frictional coupling therebetween. Also, the toothed endless element 130, as discussed above, is permitted to slip relative to sheaves 124,126 in response to the high torque loading. Thus, both slip mechanisms are operable to prevent damage to the engine 18 or drive train 20.

Turning back to FIGS. 3-6, the case 22 again includes covers 54,56,58,60,62, 64, and bracket 66. The inner primary cover 54 includes an elongated cavity 172 with a relatively smaller forward section 174 that receives the drive sprockets 50 and a relatively larger rearward section (not shown) that receives the driven sprockets 46. The cavity 172 is also operable to receive the endless chains 52.

The outer primary cover 56 has an elongated cavity 178 with forward and rearward sections 180,182 similar to those of the inner primary cover 54. The forward section 180 is substantially larger than forward section 174 in order to receive the drive sprockets 50 and the internal belt drive 92. The rearward section 182 is similarly shaped to the rearward section of the inner primary cover 54 to receive the driven sprockets 46, flywheel 44, and clutch 48. The outer primary cover 56 further includes an inner wall 184 extending along the forward section 180. The outer primary cover 56 further presents a forward opening 186 adjacent the forward section 180, an inspection opening 188, and a rearward opening 190 adjacent the rearward section 182 so that the inspection opening 188 lies between openings 186,190. The outer primary cover 56 also presents o-ring glands 192,194,196 surrounding the respective openings 186,188,190 to receive o-rings as will be discussed.

The outer primary cover 56 is attached to the inner primary cover 54 so that the respective forward ends 180,174 and rearward ends 182,176 are aligned with a gasket 198 (see FIG. 6) lying between the covers 54,56 to create a seal therebetween.

Clutch covers 58,60 are attached to the outer primary cover 56 and shaped so that they cover the rearward opening 190. The inner clutch cover 58 includes an o-ring gland 200 and is attached to outer primary cover 56 so that an o-ring 202 lies therebetween and is compressed within gland 196. The outer clutch cover 60 is attached to the inner clutch cover 58 so that an o-ring 204 lies therebetween and is compressed within gland 200 to create a seal.

Belt drive cover 62 includes an inspection port 206 and is shaped to cover the forward opening 186. The belt drive cover 62 is attached to the outer primary cover 56 to cover the forward opening 186 and arranged so that an o-ring 208 lies therebetween and is compressed within the gland 192 to create a seal. The circular inspection cover 64 includes an o-ring gland 210 and is shaped to fit within and cover the inspection port 206 of the belt drive cover 62. The inspection cover 64 is attached to the belt drive cover 62 so that an o-ring 212 lying therebetween is compressed within the gland 210 to create a seal.

The outer primary inspection cover 64 is shaped to cover the inspection opening 188 and thereby provide selective access to a chain tensioner (not shown). The inspection cover 64 is attached to the outer primary cover 56 to cover the inspection opening 188 and arranged so that an o-ring 214 lies therebetween and is compressed within the gland 194 to create a seal.

Turning back to FIGS. 3 and 4, the covers 54,56,58,60,62, 64 cooperatively form the chain case compartment 68 and the belt drive compartment 70 that are in fluid communication with each other, as discussed above. Alternatively, the two compartments 68,70 can be said to cooperatively form an enlarged chain case compartment 216. The chain case compartment 68 is similarly configured to the case compartment defined by the case of the prior art motorcycle shown in FIG. 1. The belt drive compartment 70 is spaced outwardly from the chain case compartment 68 along the crankshaft 40 and is partially formed by the outer primary cover 56 and the belt drive cover 62. The compartments 68,70 are not physically sealed from each other with a bulkhead or other dividing structure. Therefore, the compartments 68,70 are configured to be in fluid communication with each other and contain lubrication fluid as discussed above.

The configuration of the case 22 and compartments 68,70 enables the inventive drive assembly 82 to be compactly installed onto motorcycle 12. In particular, the toothed endless element 130 is spaced from the drive sprockets 50 no more than about 2.25 inches as measured parallel to the axial direction of the crankshaft 40. Also, the belt drive cover 62 is spaced from the drive sprockets 50 no more than about 3.5 inches as measured parallel to the axial direction of the shaft. When installed, the drive train 20 partially lies within the chain case compartment 68, while the internal belt drive 92 lies adjacent to the drive train 20, but substantially within the belt drive compartment 70. This compact arrangement is achieved because the internal belt drive 92 can be installed within the same chamber as the drive train 20. Therefore, compartments 68,70 do not require a bulkhead to seal the compartments 68,70 from each other. For example, if the internal belt drive 92 could not operate in the presence of lubrication fluid used in the chain case compartment 68, then the case 22 would require the compartments 68,70 to be sealed from each other with a bulkhead (not shown) and a sealed opening (not shown) to accommodate the crankshaft 40 as it extended between the adjacent compartments 68,70. The compact arrangement within the case 22 is also achieved because no bearings, bushings, or other support structures lie between the drive train 20 and the internal belt drive 92 that would limit the close arrangement of the drive train 20 and the internal belt drive 92.

In operation, the engine 18 of the supercharged motorcycle 10 drivingly engages the drive assembly 82 that in turn rotates the supercharger 78 to provide compressed induction fluid to the engine 18. The internal belt drive 92 operates within and is supported by the modified case 22 to enable the inventive drive assembly 82 to be compactly arranged on the supercharged motorcycle 10. The internal belt drive 92 further provides a slip mechanism between the drive assembly 82 and the engine 18 in the event of a catastrophic failure within the air induction system 14.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A motorcycle comprising:

a chassis operable to be mounted by a rider;

front and rear wheels that support the chassis with the rear wheel being longitudinally spaced from the front wheel;

an engine including a rotatable crankshaft generally positioned between the wheels;

a drive train drivingly interconnecting the crankshaft and the rear wheel;

an air induction system delivering compressed induction fluid to the engine, said air induction system including a supercharger and a drive assembly, said drive assembly including a drive sheave fixed to the crank shaft, said drive assembly including a driven sheave and an endless belt drivingly entraining the sheaves, said drive assembly at least partly drivingly interconnecting said supercharger and said crankshaft; and a case fixed to the chassis and defining first and second compartments, at least part of the drive train including an endless drive component located within the first compartment, said driven sheave located within the second compartment and said endless belt being at least partly located within the second compartment, said first and second compartments being in fluid communication with each other.

2. The motorcycle as claimed in claim 1, said case being at least partly filled with transmission fluid, said endless belt and the at least a portion of the drive train being at least partly submerged in the fluid.

3. The motorcycle as claimed in claim 1, said drive assembly including an external belt drive drivingly interconnecting the supercharger and the driven sheave and located externally of the case.

4. The motorcycle as claimed in claim 1, said belt presenting a toothed drive surface, said drive sheave presenting a belt-engaging surface, said belt-engaging surface presenting circumferentially spaced teeth drivingly intermeshing with the toothed drive surface of the belt.

5. A motorcycle comprising:

a chassis operable to be mounted by a rider;

front and rear wheels that support the chassis with the rear wheel being longitudinally spaced from the front wheel;

an engine including a rotatable crankshaft generally positioned between the wheels;

a drive train drivingly interconnecting the crankshaft and the rear wheel;

an air induction system delivering compressed induction fluid to the engine, said air induction system including a supercharger and a drive assembly including an endless element, said drive assembly at least partly drivingly interconnecting said supercharger and said crankshaft; and a case fixed to the chassis and defining first and second compartments, at least part of the drive train being located within the first compartment, said endless element being at least partly located within the second compartment, said first and second compartments being in fluid communication with each other, said drive assembly including a drive sheave presenting a belt-engaging surface, said endless element comprising a belt drivingly entraining the drive sheave, said sheave presenting a recessed fluid flow passageway extending inwardly from the belt-engaging surface to relieve hydrodynamic forces between the sheave and the belt.

6. The motorcycle as claimed in claim 5, said sheave presenting a laterally open internal cavity spaced radially inward from the belt-engaging surface, said cavity fluidly communicating with the fluid flow passageway.

7. The motorcycle as claimed in claim 6, said sheave including an annular wall, an outer surface of which presents the belt-engaging surface and an inner surface of which at least partly defines the internal cavity.

8. The motorcycle as claimed in claim 7, said passageway comprising a plurality of holes extending between the surfaces of the annular wall.

9. The motorcycle as claimed in claim 8, said belt and said sheave being toothed such that each present axially extending spaces defined between adjacent teeth and configured to receive one of the teeth of the other, each of said holes being located within a corresponding one of the spaces of the sheave.

10. The motorcycle as claimed in claim 9, said spaces of the sheave each including a plurality of the holes spaced axially along the length thereof.

11. The motorcycle as claimed in claim 10, said passageway further comprising an axially extending groove that projects inwardly from each space and is open at opposite sides of the sheave, said belt and said sheave being configured so that the teeth of the belt remain substantially outside of the grooves when received in the spaces.

12. The motorcycle as claimed in claim 6, said passageway comprising a plurality of holes extending inwardly from the belt-engaging surface to the internal cavity.

13. The motorcycle as claimed in claim 5, said belt and said sheave being toothed such that each present axially extending spaces defined between adjacent teeth and configured to receive one of the teeth of the other, said passageway comprising an axially extending groove that projects inwardly from each space and is open at opposite sides of the sheave, said belt and said sheave being configured so that the teeth of the belt remain substantially outside of the grooves when received in the spaces.

14. The motorcycle as claimed in claim 1, said endless drive component interconnected to the endless belt by a shaft, said component and said belt being mounted so that the shaft provides a common axis of rotation therefor, said endless belt being spaced from the drive component no more than about 2.25 inches as measured parallel to the axial direction of the shaft.

15. The motorcycle as claimed in claim 14, said endless belt being spaced between the drive component and a farthest outboard portion of the case, said farthest outboard portion of the case being spaced from the drive component no more than about 3.5 inches as measured along the axial direction of the shaft.

16. A motorcycle comprising:

a chassis operable to be mounted by a rider;

front and rear wheels that support the chassis with the rear wheel being longitudinally spaced from the front wheel;

an engine including a rotatable crankshaft generally positioned between the wheels;

a drive train drivingly interconnecting the crankshaft and the rear wheel;

an air induction system delivering compressed induction fluid to the engine, said air induction system including a supercharger and a drive assembly including an endless element, said drive assembly at least partly drivingly interconnecting said supercharger and said crankshaft; and a case fixed to the chassis and defining first and second compartments, at least part of the drive train being located within the first compartment, said endless element being at least partly located within the second compartment, said first and second compartments being in fluid communication with each other, said drive assembly including a drive member for drivingly engaging the endless element, said drive member being frictionally coupled relative to the crankshaft so as to permit the crankshaft to power the drive member below a selected torque level determined by the amount of friction therebetween.

17. The motorcycle as claimed in claim 16, said drive train including a sleeve that is slidably mounted on the crankshaft and a fastener that secures the sleeve on the crankshaft with the drive member being secured between the fastener and the sleeve and frictionally coupled thereto.

18. The motorcycle as claimed in claim 16, said drive train including an endless drive component and a drive sprocket mounted on the crankshaft, said drive sprocket drivingly engaging the endless drive component, said drive train including a coupling that interconnects the drive sprocket and crankshaft, said drive member including a cavity and being mounted on the crankshaft so that the cavity at least partly receives the coupling therein.

19. The motorcycle as claimed in claim 1, said case including an outer primary cover fixed relative to the chassis, said outer primary cover including inner and outer sides and an opening that extends from the inner side to the outer side, said outer primary cover separating the first and second compartments, with the second compartment being outboard of the first compartment.

20. The motorcycle as claimed in claim 19, said case including a drive cover sealingly attached to and outboard of the outer primary cover, said drive cover and said outer primary cover cooperatively defining the second compartment, with the first and second compartments intercommunicating via the opening of the outer primary cover.

* * * * *